US009427372B1

(12) United States Patent
Minassian

(10) Patent No.: US 9,427,372 B1
(45) Date of Patent: Aug. 30, 2016

(54) SHOULDER ROTATING APPARATUS

(71) Applicant: Arlen Minassian, Granada Hills, CA (US)

(72) Inventor: Arlen Minassian, Granada Hills, CA (US)

( * ) Notice: Subject to any disclaimer, the term of this patent is extended or adjusted under 35 U.S.C. 154(b) by 403 days.

(21) Appl. No.: 14/048,432

(22) Filed: Oct. 8, 2013

(51) Int. Cl.
*A61H 1/02* (2006.01)

(52) U.S. Cl.
CPC ..... *A61H 1/0281* (2013.01)

(58) Field of Classification Search
CPC ..... A61H 1/02; A61H 1/0281; A61H 2001/0203; A61H 2201/16; A61H 2201/1614; A61H 2201/1616; A61H 2201/0153; A61H 2201/1671; A61H 2203/0456; A61H 2205/062; A61H 2205/065; A63B 23/1263; A63B 2220/24; A63B 2071/0633; A63B 2208/0252; A63B 2023/006; A63B 21/008; A63B 23/1245
See application file for complete search history.

(56) References Cited

U.S. PATENT DOCUMENTS

| | | | | |
|---|---|---|---|---|
| 4,768,783 | A | 9/1988 | Engalitcheff, Jr. | |
| 4,772,015 | A * | 9/1988 | Carlson | A63B 21/4047 482/902 |
| D304,058 | S | 10/1989 | Carlson et al. | |
| 5,080,350 | A | 1/1992 | Schofield et al. | |
| 5,179,939 | A | 1/1993 | Donovan et al. | |
| 5,520,615 | A | 5/1996 | Fontana et al. | |
| 5,645,521 | A * | 7/1997 | Hepburn | A63B 21/015 482/130 |
| D475,757 | S | 6/2003 | Silverman et al. | |
| 7,621,857 | B2 * | 11/2009 | Pompile | A63B 21/0552 482/129 |
| 7,717,834 | B2 | 5/2010 | Kay | |
| 7,976,444 | B2 | 7/2011 | Binns et al. | |
| 2010/0234776 | A1 | 9/2010 | Borden | |
| 2012/0035512 | A1 * | 2/2012 | Su | A61H 1/0281 601/5 |

* cited by examiner

*Primary Examiner* — Quang D Thanh

(57) ABSTRACT

A shoulder rotating apparatus assists a user in regaining strength and range of motion in the user's shoulder after shoulder injuries or surgery. The apparatus includes a base and a support plate. A support assembly couples the support plate to the base. A track extends into a bottom of the support plate. A ball is positionable within the track. A strap is coupled to the ball and is configured for securing to a hand of a user such that movement of the ball within the track facilitates movement of the shoulder and upper arm of the user when the user's hand is positioned within the strap.

15 Claims, 4 Drawing Sheets

SHOULDER ROTATING APPARATUS

BACKGROUND OF THE DISCLOSURE

Field of the Disclosure

The disclosure relates to rehabilitation devices and more particularly pertains to a new rehabilitation device for assisting a user in regaining strength and range of motion in the user's shoulder after shoulder injuries or surgery.

SUMMARY OF THE DISCLOSURE

An embodiment of the disclosure meets the needs presented above by generally comprising a base and a support plate. A support assembly couples the support plate to the base. A track extends into a bottom of the support plate. A ball is positionable within the track. A strap is coupled to the ball and is configured for securing to a hand of a user such that movement of the ball within the track facilitates movement of the shoulder and upper arm of the user when the user's hand is positioned within the strap.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
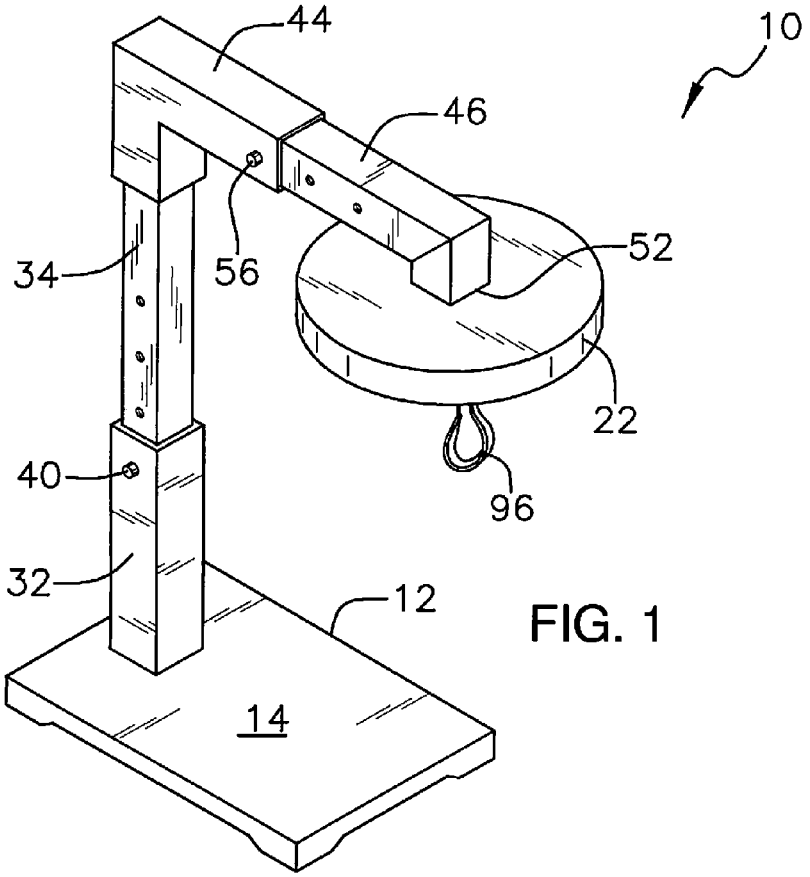
FIG. 1 is a top front side perspective view of a shoulder rotating apparatus according to an embodiment of the disclosure.
Figure 2:
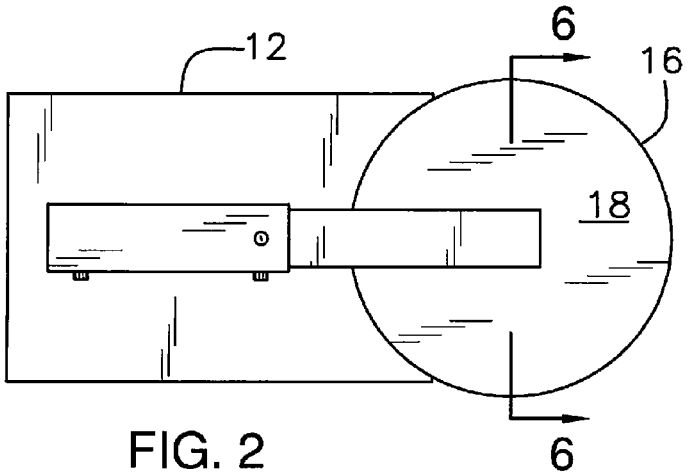
FIG. 2 is a top view of an embodiment of the disclosure.
Figure 3:
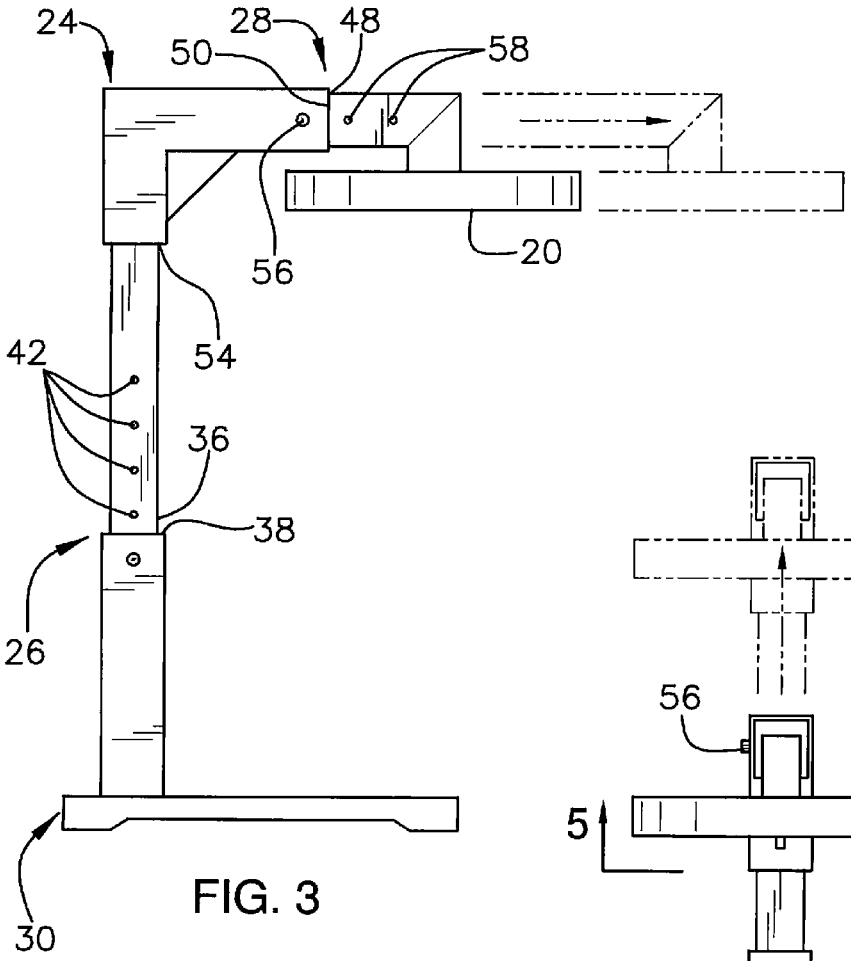
FIG. 3 is a side view of an embodiment of the disclosure.
Figure 4:
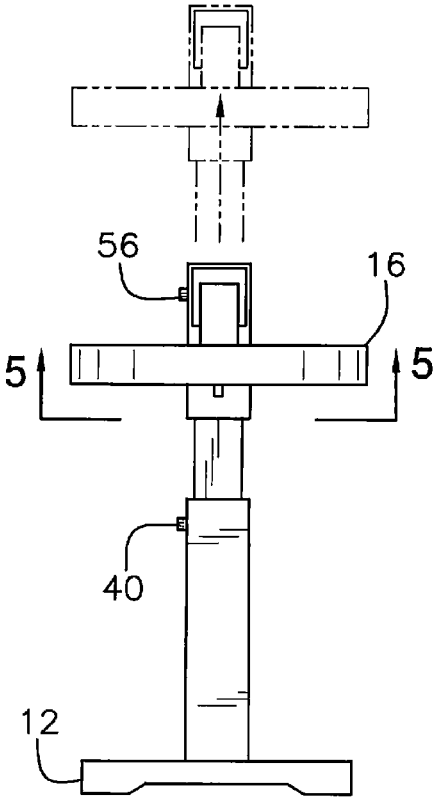
FIG. 4 is a front view of an embodiment of the disclosure.
Figure 5:
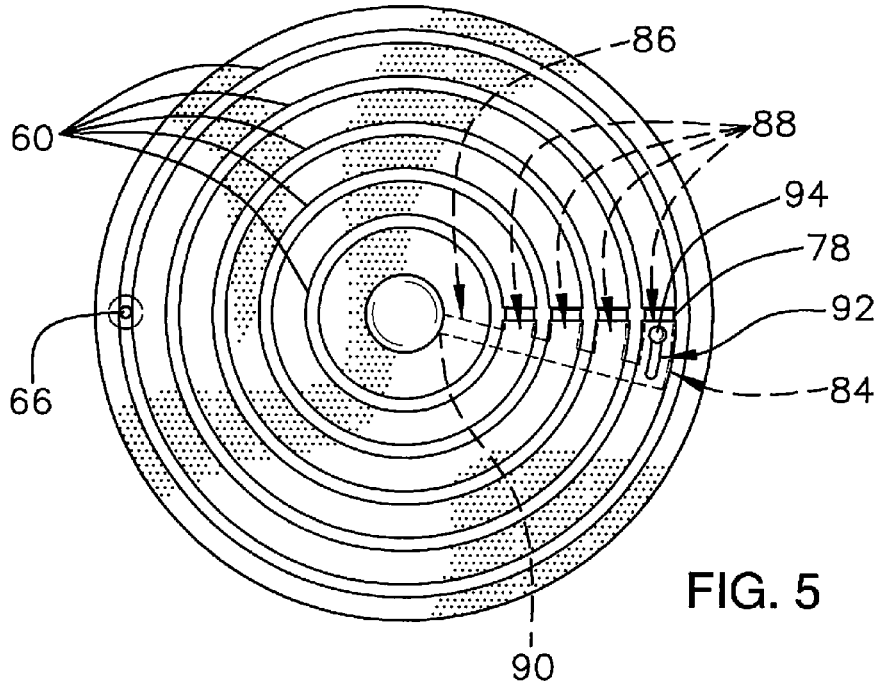
FIG. 5 is a bottom view of a support plate of an embodiment of the disclosure taken along line 5-5 of FIG. 4.
Figure 6:
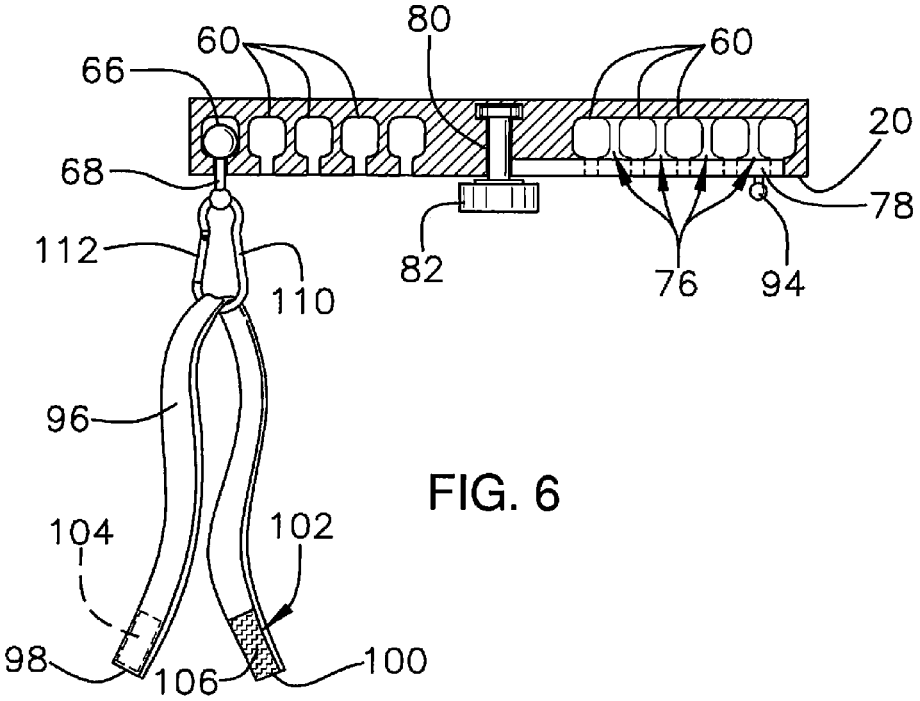
FIG. 6 is a cross-sectional view of an embodiment of the disclosure taken along line 6-6 of FIG. 2.
Figure 7:
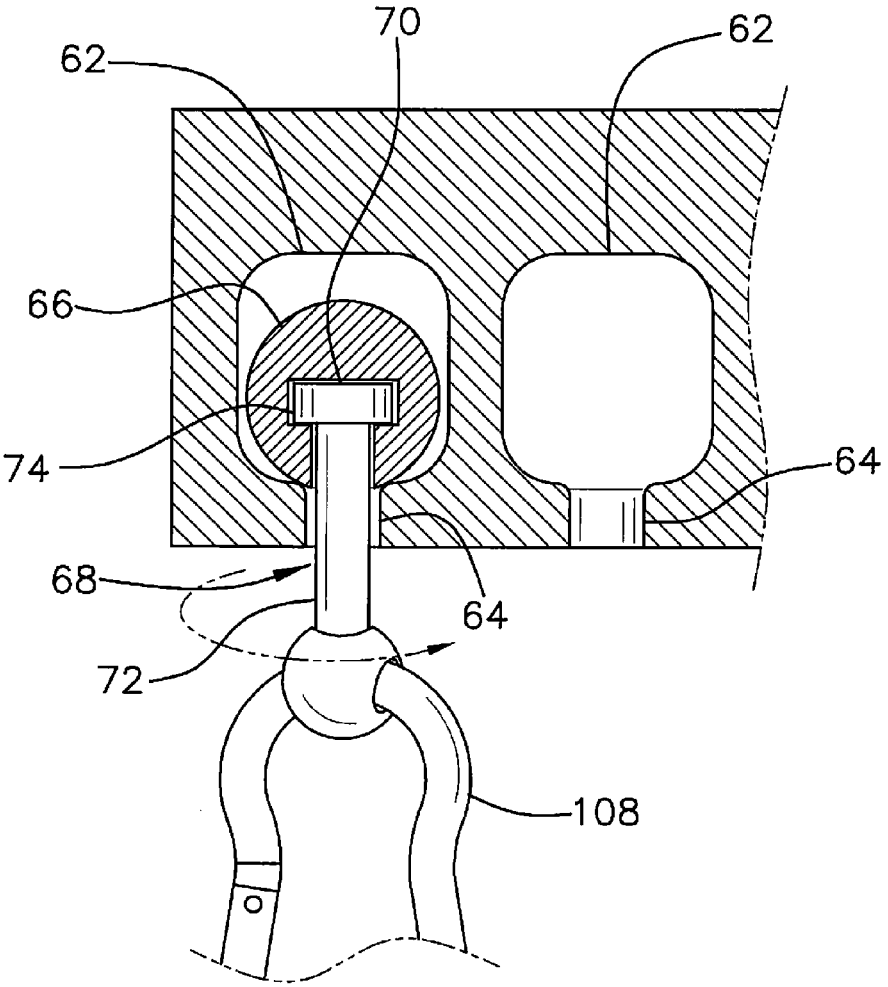
FIG. 7 shows a cross-sectional view of an embodiment of the disclosure similar to FIG. 6 except that FIG. 7 shows an interior of the ball positioned within one of the tracks.

With reference now to the drawings, and in particular to FIGS. 1 through 7 thereof, a new rehabilitation device embodying the principles and concepts of an embodiment of the disclosure and generally designated by the reference numeral 10 will be described.

As best illustrated in FIGS. 1 through 7, the shoulder rotating apparatus 10 generally comprises a base 12. A top surface 14 of the base 12 is planar and may be triangular, rectangular, or any other suitable shape. A support plate 16 has a top 18, a bottom 20 and a perimeter wall 22 coupled to and extending between the top 18 and the bottom 20. The support plate 16 may be annular.

A support assembly 24 couples the support plate 16 to the base 12. The support assembly 24 comprises a post 26 and a support arm 28 being coupled to the post 26. The post 26 extends upwardly from the top surface 14 of the base 12. The post 26 may be positioned proximate a back end 30 of the base 12. The post 26 may have a lower member 32 and an upper member 34 wherein a lower end 36 of the upper member 34 is slidably insertable into an upper end 38 of the lower member 32 such that a height of the post 26 is selectively adjustable. The support assembly 24 may also comprise a first fixing pin 40 being passed through aligned holes 42 in the upper 34 and lower 32 members whereby the upper 34 and lower 32 members are secured together. The support arm 28 may have a first member 44 and a second member 46 wherein a first end 48 of the second member 46 is slidably insertable into a second end 50 of the first member 44 such that a second end 52 of the second member 46 is positioned at a selectable length relative to the post 26. The first member 44 is coupled to a top end 54 of the upper member 34. The second end 52 of the second member 46 may be positioned above the base 12 when the support arm 28 is fully extended. In this manner, the user may rest his head and/or upper back on the top surface 14 of the base 12. Each of the first 44 and second 46 members may be L-shaped. The second end 52 of the second member 46 is coupled to the top 18 of the support plate 16. A second fixing pin 56 may be passed through aligned apertures 58 in the first 44 and second 46 members whereby the first 44 and second 46 members are secured together.

A plurality of tracks 60 extend into the bottom 20 of the support plate 16. Although five tracks 60 are shown in the Figures, fewer tracks 60 may be used. The tracks 60 may be arranged into concentric circles. Each of the tracks 60 has a main portion 62 and a neck 64. Each of the necks 64 couples an associated one of the main portions 62 to the bottom 20 of the support plate 16. A ball 66 is positionable within a selectable one of the tracks 60. The ball 66 has a size and shape such that the ball 66 is retained within a selectable one of the main portions 62. The ball 66 is configured to support up to twenty pounds of weight. A connector 68 is coupled to the ball 66. A top end 70 of the connector 68 is positioned within the ball 66. A lower end 72 of the connector 68 extends outwardly of one of the tracks 60 through an associated one of the necks 64. An upper portion 74 of the connector 68 is rotatable relative to the ball 66. A plurality of arcuate radial slots 76 each extend between adjacently positioned pairs of the tracks 70. The slots 76 are configured to permit movement of the ball 66 between the associated adjacently positioned pairs of the tracks 60. A door 78 extends between the tracks 60.

A hub 80 is coupled to a center of the support plate 16. A lower portion 82 of the hub 80 extends outwardly of the bottom 20 of the support plate 16. An arm assembly 84 is coupled to the hub 80. The arm assembly 84 comprises a crank arm 86 and a plurality of projections 88 coupled to and extending outwardly from the crank arm 86. The crank arm 86 extends across the tracks 60. The crank arm 86 has a first end 90 pivotally coupled to the hub 80. Each of the projections 88 is selectively positionable to provide access to the slots 76. A slit 92 is positioned in the bottom 20 of the support plate 16. A knob 94 is provided. The knob 94 extends outwardly of the slit 92 such that the knob 94 is graspable by the user. The knob 94 is coupled to the arm assembly 84. The knob 94 is mechanically coupled to the arm assembly 84 wherein manipulation of the knob 94 pivots the crank arm 86 about the hub 80.

A strap 96 is coupled to the ball 66. The strap 96 is configured for securing to a hand of a user such that movement of the ball 66 within the tracks 60 facilitates movement of the shoulder and upper arm of the user when the user's hand is positioned within the strap 96. The strap 96 has a first end edge 98 and a second end edge 100. A fastener 102 is coupled to the strap 96. The fastener 102 comprises a first mating member 104 positioned proximate the first end edge 98 and a second mating member 106 positioned proximate the second end edge 100. The first mating member 104 is couplable to the second mating member 106. The strap 96 forms a closed loop when the first 104 and second 106 mating members are coupled together. The fastener 102 may comprise a hook and loop fastener, snaps, or the like. A clasp 108 is coupled to the lower end 72 of the connector 68. The clasp 108 couples the ball 66 to the strap 96. The clasp 108 may comprise a loop 110 and a release gate 112. The release gate 112 is pivotally coupled to the loop 110 wherein manipulation of the release gate 112 opens and closes the release gate 112 to permit attachment of the clasp 108 to the ball 66.

The apparatus 10 may have a height between 90.0 centimeters and 125.0 centimeters; and each of a length and a width between 55.0 centimeters and 65.0 centimeters.

In use, as stated above and shown in the Figures, the user lies down in a supine position and secures his hand to the strap 96. The user should be positioned such that the head and upper back of the user rests on the top surface 14 of the base 12. The user then rotates his arm around the tracks 60 to facilitate rehabilitation of the user's shoulder. As the user regains flexibility in his joints, the height of the support assembly 24 is gradually increased. The knob 94 is also manipulated as the rehabilitation progresses wherein manipulation of the knob 94 moves the ball 66 to an outwardly positioned track 60. In this manner, the apparatus 10 helps a user to regain strength and range of motion in the user's shoulder joints after surgery or injury.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A shoulder rotating apparatus comprising:

a base;

a support plate having a top, a bottom and a perimeter wall coupled to and extending between said top and said bottom;

a support assembly coupling said support plate to said base;

a track extending into said bottom of said support plate;

a ball positionable within said track; and a strap coupled to said ball, said strap being configured for securing to a hand of a user such that movement of said ball within said track facilitates movement of a shoulder and upper arm of the user when the user's hand is positioned within said strap.

2. The apparatus of claim 1, said support assembly including:

a post extending upwardly from a top surface of said base; and a support arm coupled to said post.

3. The apparatus of claim 2, further comprising:

an upper member and a lower member of said post, a lower end of said upper member being slidably insertable into an upper end of said lower member such that a height of said post is selectively adjustable; and a first fixing pin being passed through aligned holes in said upper and lower members whereby said upper and lower members are secured together.

4. The apparatus of claim 2, further comprising:

a first member and a second member of said support arm, said first member being coupled to a top end of said upper member, a first end of said second member being slidably insertable into a second end of said first member such that a second end of said second member is positioned at a selectable length relative to said post, said second end of said second member being coupled to said top of said support plate; and a second fixing pin being passed through aligned apertures in said first and second members whereby said first and second members are secured together.

5. The apparatus of claim 4, further comprising said second end of said second member being positioned above said base when said support arm is fully extended.

6. The apparatus of claim 1, further comprising said track being one of a plurality of tracks.

7. The apparatus of claim 6, further comprising:

a plurality of arcuate radial slots each extending between adjacently positioned pairs of said tracks, said slots being configured to permit movement of said ball between said associated adjacently positioned pairs of said tracks;

a hub coupled to a center of said support plate, a lower portion of said hub extending outwardly of said bottom of said support plate;

an arm assembly coupled to said hub, said arm assembly comprising a crank arm and a plurality of projections coupled to and extending outwardly from said crank arm, said crank arm extending across said tracks, said crank arm having a first end pivotally coupled to said hub, each of said projections being selectively positionable to provide access to said slots; and a door extending between said tracks.

8. The apparatus of claim 7, further comprising:

a slit positioned in said bottom of said support plate; and a knob extending outwardly of said slit such that said knob is graspable by the user, said knob being coupled to said arm assembly, said knob being mechanically coupled to said arm assembly wherein manipulation of said knob pivots said crank arm about said hub.

9. The apparatus of claim 6, further comprising:

each of said tracks having a main portion and a neck, each of said necks coupling an associated one of said main portions to said bottom of said support plate; and said ball having a size and shape such that said ball is retained within a selectable one of said main portions.

10. The apparatus of claim 6, further comprising:

said strap being releasably coupled to said ball, said strap having a first end edge and a second end edge; and a fastener coupled to said strap, said fastener comprising a first mating member positioned proximate said first end edge and a second mating member positioned proximate said second end edge, said first mating member being couplable to said second mating member, said strap forming a closed loop when said first and second mating members are coupled together, said fastener comprising a hook and loop fastener.

11. The apparatus of claim 9, further comprising:

a connector coupled to said ball, a top end of said connector being positioned within said ball, a lower end of said connector extending outwardly of one of said tracks through an associated one of said necks; and a clasp coupled to said lower end of said connector, said clasp coupling said ball to said strap, said clasp comprising a loop and a release gate, said release gate being pivotally coupled to said loop wherein manipulation of said release gate opens and closes said release gate to permit attachment of said clasp to said ball.

12. The apparatus of claim 11, further comprising an upper portion of said connector being rotatable relative to said ball.

13. The apparatus of claim 1, further comprising said support plate being annular.

14. The apparatus of claim 2, further comprising a top surface of said base being planar, said post being positioned proximate a back end of said base.

15. A shoulder rotating apparatus comprising:

a base, a top surface of said base being planar;

a support plate having a top, a bottom and a perimeter wall coupled to and extending between said top and said bottom, said support plate being annular;

a support assembly coupling said support plate to said base, said support assembly comprising a post extending upwardly from said top surface of said base, said post being positioned proximate a back end of said base, said post having a lower member and an upper member, a lower end of said upper member being slidably insertable into an upper end of said lower member such that a height of said post is selectively adjustable, a first fixing pin being passed through aligned holes in said upper and lower members whereby said upper and lower members are secured together, a support arm coupled to said post, said support arm having a first member and a second member, said first member being coupled to a top end of said upper member, a first end of said second member being slidably insertable into a second end of said first member such that a second end of said second member is positioned at a selectable length relative to said post, said second end of said second member being coupled to said top of said support plate, said second end of said second member being positioned above said base when said support arm is fully extended, each of said first and second members being L-shaped, and a second fixing pin being passed through aligned apertures in said first and second members whereby said first and second members are secured together;

a plurality of tracks extending into said bottom of said support plate, said tracks being arranged into concentric circles, each of said tracks having a main portion and a neck, each of said necks coupling an associated one of said main portions to said bottom of said support plate;

a ball positionable within a selectable one of said tracks, said ball having a size and shape such that said ball is retained within a selectable one of said main portions;

a connector coupled to said ball, a top end of said connector being positioned within said ball, a lower end of said connector extending outwardly of one of said tracks through an associated one of said necks, an upper portion of said connector being rotatable relative to said ball;

a plurality of arcuate radial slots each extending between adjacently positioned pairs of said tracks, said slots being configured to permit movement of said ball between said associated adjacently positioned pairs of said tracks;

a hub coupled to a center of said support plate, a lower portion of said hub extending outwardly of said bottom of said support plate;

an arm assembly coupled to said hub, said arm assembly comprising a crank arm and a plurality of projections coupled to and extending outwardly from said crank arm, said crank arm extending across said tracks, said crank arm having a first end pivotally coupled to said hub, each of said projections being selectively positionable to provide access to said slots;

a slit positioned in said bottom of said support plate;

a knob, said knob extending outwardly of said slit such that said knob is graspable by the user, said knob being coupled to said arm assembly, said knob being mechanically coupled to said arm assembly wherein manipulation of said knob pivots said crank arm about said hub;

a door extending between said tracks;

a strap coupled to said ball, said strap being configured for securing to a hand of a user such that movement of said ball within said tracks facilitates movement of a shoulder and upper arm of the user when the user's hand is positioned within said strap, said strap having a first end edge and a second end edge;

a fastener coupled to said strap, said fastener comprising a first mating member positioned proximate said first end edge and a second mating member positioned proximate said second end edge, said first mating member being couplable to said second mating member, said strap forming a closed loop when said first and second mating members are coupled together, said fastener comprising a hook and loop fastener; and a clasp coupled to said lower end of said connector, said clasp coupling said ball to said strap, said clasp comprising a loop and a release gate, said release gate being pivotally coupled to said loop wherein manipulation of said release gate opens and closes said release gate to permit attachment of said clasp to said ball.

* * * * *